US010481517B2

(12) United States Patent
Iwasaki et al.

(10) Patent No.: US 10,481,517 B2
(45) Date of Patent: Nov. 19, 2019

(54) CLEANING MEMBER, CHARGING DEVICE, AND IMAGE FORMING APPARATUS

(71) Applicant: FUJI XEROX CO., LTD., Tokyo (JP)

(72) Inventors: Jin Iwasaki, Kanagawa (JP); Ken Ozaki, Kanagawa (JP)

(73) Assignee: FUJI XEROX CO., LTD., Minato-ku, Tokyo (JP)

( * ) Notice: Subject to any disclaimer, the term of this patent is extended or adjusted under 35 U.S.C. 154(b) by 0 days.

(21) Appl. No.: 15/715,226

(22) Filed: Sep. 26, 2017

(65) Prior Publication Data

US 2018/0275553 A1 Sep. 27, 2018

(30) Foreign Application Priority Data

Mar. 21, 2017 (JP) ..... 2017-054501

(51) Int. Cl.
*G03G 15/02* (2006.01)
*G03G 21/00* (2006.01)
(Continued)

(52) U.S. Cl.
CPC ..... *G03G 15/0258* (2013.01); *G03G 15/0225* (2013.01); *G03G 15/0233* (2013.01); *G03G 15/0291* (2013.01); *G03G 15/161* (2013.01); *G03G 15/166* (2013.01); *G03G 15/168* (2013.01); *G03G 15/2025* (2013.01); *G03G 21/00* (2013.01); *G03G 21/007* (2013.01); *G03G 21/0035* (2013.01); *G03G 21/0058* (2013.01); *G03G 21/0076* (2013.01); *G03G 21/169* (2013.01); *G03G 21/1814* (2013.01); *G03G 2215/1647* (2013.01); *G03G 2215/1657* (2013.01); *G03G 2215/1661* (2013.01);
(Continued)

(58) Field of Classification Search
CPC ..... G03G 15/0225; G03G 15/0233; G03G 15/0258; G03G 15/0291; G03G 15/161; G03G 15/166; G03G 15/168; G03G 15/2025; G03G 15/2075; G03G 21/00; G03G 21/0035; G03G 21/0058; G03G 21/007; G03G 21/0076; G03G 21/169; G03G 21/1814; G03G 2215/1647; G03G 2215/1657; G03G 2215/1661; G03G 2221/00; G03G 2221/0068; G03G 2221/0089
See application file for complete search history.

(56) References Cited

U.S. PATENT DOCUMENTS

| | | | | |
|---|---|---|---|---|
| 6,739,160 | B1 | 5/2004 | Hiraga et al. | |
| 9,025,993 | B2 | 5/2015 | Iwasaki et al. | |
| 2016/0313691 | A1* | 10/2016 | Imanaka | G03G 21/0035 |

FOREIGN PATENT DOCUMENTS

| | | | |
|---|---|---|---|
| JP | 2003-271032 | A | 9/2003 |
| JP | 2014-240866 | A | 12/2014 |
| WO | 99/35958 | A1 | 7/1999 |

* cited by examiner

*Primary Examiner* — Joseph S Wong
(74) *Attorney, Agent, or Firm* — Sughrue Mion, PLLC

(57) ABSTRACT

A cleaning member includes plural bristles including tips that come into contact with an object to be cleaned having a surface including recesses and projections; and a brush base to which the bristles are attached. The bristles each have a non-circular cross-section including a projecting portion that projects toward an outer periphery, at least the projecting portion having a size such that the projecting portion is capable of entering the recesses in the object to be cleaned.

17 Claims, 15 Drawing Sheets

(51) Int. Cl.

| | |
|---|---|
| ***G03G 15/16*** | (2006.01) |
| ***G03G 15/20*** | (2006.01) |
| ***G03G 21/16*** | (2006.01) |
| ***G03G 21/18*** | (2006.01) |

(52) U.S. Cl.
CPC . *G03G 2221/00* (2013.01); *G03G 2221/0068* (2013.01); *G03G 2221/0089* (2013.01)

FIG. 15

| | DIAMETER OF FIRST BRISTLES | TIP DIAMETER OF SECOND BRISTLES (NON-CIRCULAR CROSS-SECTION FIBERS) | INCREASE IN RESISTANCE OF CHARGING ROLLER [logΩ] | STREAKS ON PRINT SAMPLE | RESULT OF SEM OBSERVATION |
|---|---|---|---|---|---|
| EXPERIMENTAL EXAMPLE 1 | 80 (50 d) | 8 (Y-SHAPED 30 d) | 1.2 | GOOD | SLIGHT ADHESION TO PROJECTIONS, AND SMALL ACCUMULATION IN RECESSES |
| EXPERIMENTAL EXAMPLE 2 | — | 8 (Y-SHAPED 30 d) | 2.2 | FAIR | SMALL ACCUMULATION IN RECESSES, BUT SOMEWHAT SEVERE ADHESION TO PROJECTIONS |
| EXPERIMENTAL EXAMPLE 3 | — | 36 (TRIANGULAR 30 d) | 2.5 | FAIR | SMALL ACCUMULATION IN RECESSES, BUT SOMEWHAT SEVERE ADHESION TO PROJECTIONS |
| COMPARATIVE EXAMPLE 1 | 80 (50 d) | — | 4.5 | BAD | SLIGHT ADHESION TO PROJECTIONS, BUT VERY LARGE ACCUMULATION IN RECESSES |
| COMPARATIVE EXAMPLE 2 | 80 (50 d) | 28 (6 d) | 3.8 | BAD | SLIGHT ADHESION TO PROJECTIONS, BUT LARGE ACCUMULATION IN RECESSES |
| COMPARATIVE EXAMPLE 3 | — | 8 (0.5 d) | 5 | VERY BAD | VERY SEVERE ADHESION TO PROJECTIONS, AND LARGE ACCUMULATION IN RECESSES |
| COMPARATIVE EXAMPLE 4 | — | 10 (0.8 d) | 4.5 | VERY BAD | VERY SEVERE ADHESION TO PROJECTIONS, AND LARGE ACCUMULATION IN RECESSES |
| COMPARATIVE EXAMPLE 5 | — | 16 (2 d) | 4.8 | VERY BAD | VERY SEVERE ADHESION TO PROJECTIONS, AND LARGE ACCUMULATION IN RECESSES |
| COMPARATIVE EXAMPLE 6 | — | 28 (6 d) | 4.2 | VERY BAD | VERY SEVERE ADHESION TO PROJECTIONS, AND LARGE ACCUMULATION IN RECESSES |

| FIBER TIP DIAMETER | CIRCULAR CROSS-SECTION | ELONGATED CROSS-SECTION | TRIANGULAR CROSS-SECTION | Y-SHAPED CROSS-SECTION |
|---|---|---|---|---|
| 8 | | | | 100 |
| 11.3 | 30 | 60 | 82 | |
| 16 | 44 | | | |
| 35.8 | 75 | | 97 | |

| FIBER TIP DIAMETER | CIRCULAR CROSS-SECTION | ELONGATED CROSS-SECTION | TRIANGULAR CROSS-SECTION | Y-SHAPED CROSS-SECTION |
|---|---|---|---|---|
| 8 | | | | 30 d |
| 11.3 | 1 d | 2 d | 3 d | |
| 16 | 2 d | | | |
| 35.8 | 10 d | | 30 d | |

| FIBER DENIER | CIRCULAR CROSS-SECTION | ELONGATED CROSS-SECTION | TRIANGULAR CROSS-SECTION | Y-SHAPED CROSS-SECTION |
|---|---|---|---|---|
| 1 | 30 | | | |
| 2 | 44 | 60 | | |
| 10 | 75 | | | |
| 3 | | | 82 | |
| 30 | | | 97 | 100 |

CLEANING MEMBER, CHARGING DEVICE, AND IMAGE FORMING APPARATUS

CROSS-REFERENCE TO RELATED APPLICATIONS

This application is based on and claims priority under 35 USC 119 from Japanese Patent Application No. 2017-054501 filed Mar. 21, 2017.

BACKGROUND (i) Technical Field

The present invention relates to a cleaning member, a charging device, and an image forming apparatus.

(ii) Related Art

An example of a known image forming apparatus includes a charging roller that is brought into contact with a surface of a photoconductor drum to charge the surface of the photoconductor drum with the charging roller, and a cleaning member that cleans a surface of the charging roller.

SUMMARY

According to an aspect of the invention, there is provided a cleaning member including plural bristles including tips that come into contact with an object to be cleaned having a surface including recesses and projections; and a brush base to which the bristles are attached. The bristles each have a non-circular cross-section including a projecting portion that projects toward an outer periphery, at least the projecting portion having a size such that the projecting portion is capable of entering the recesses in the object to be cleaned.

BRIEF DESCRIPTION OF THE DRAWINGS

An exemplary embodiment of the present invention will be described in detail based on the following figures, wherein:

FIG. 15 is a table showing the results of Experimental Examples 1 to 3 and Comparative Examples 1 to 6;

DETAILED DESCRIPTION

An exemplary embodiment of the present invention will now be described with reference to the drawings.

Figure 1:
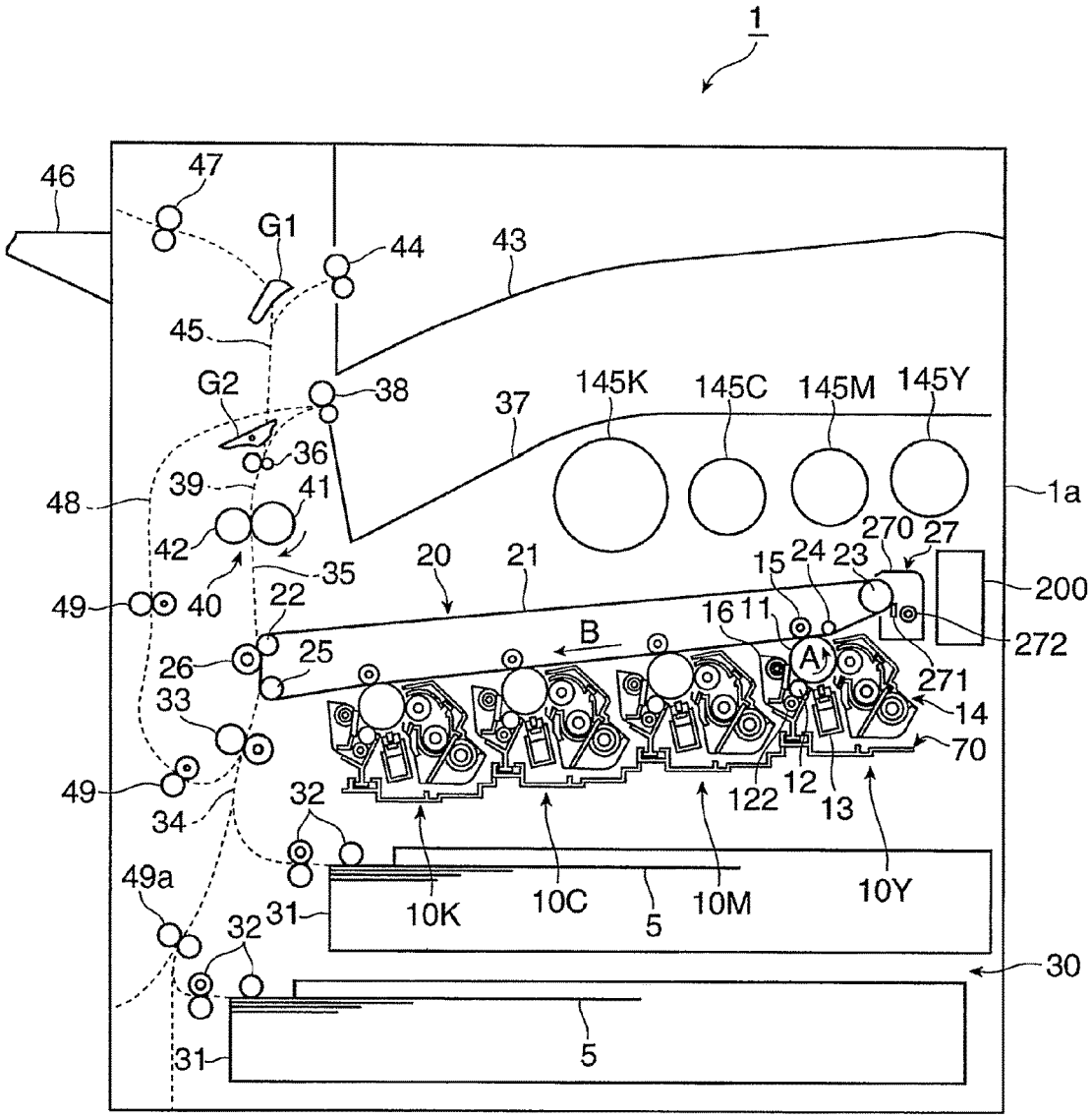
FIG. 1 is a schematic diagram illustrating an image forming apparatus including a cleaning member and a charging device according to an exemplary embodiment of the present invention.
Figure 2:
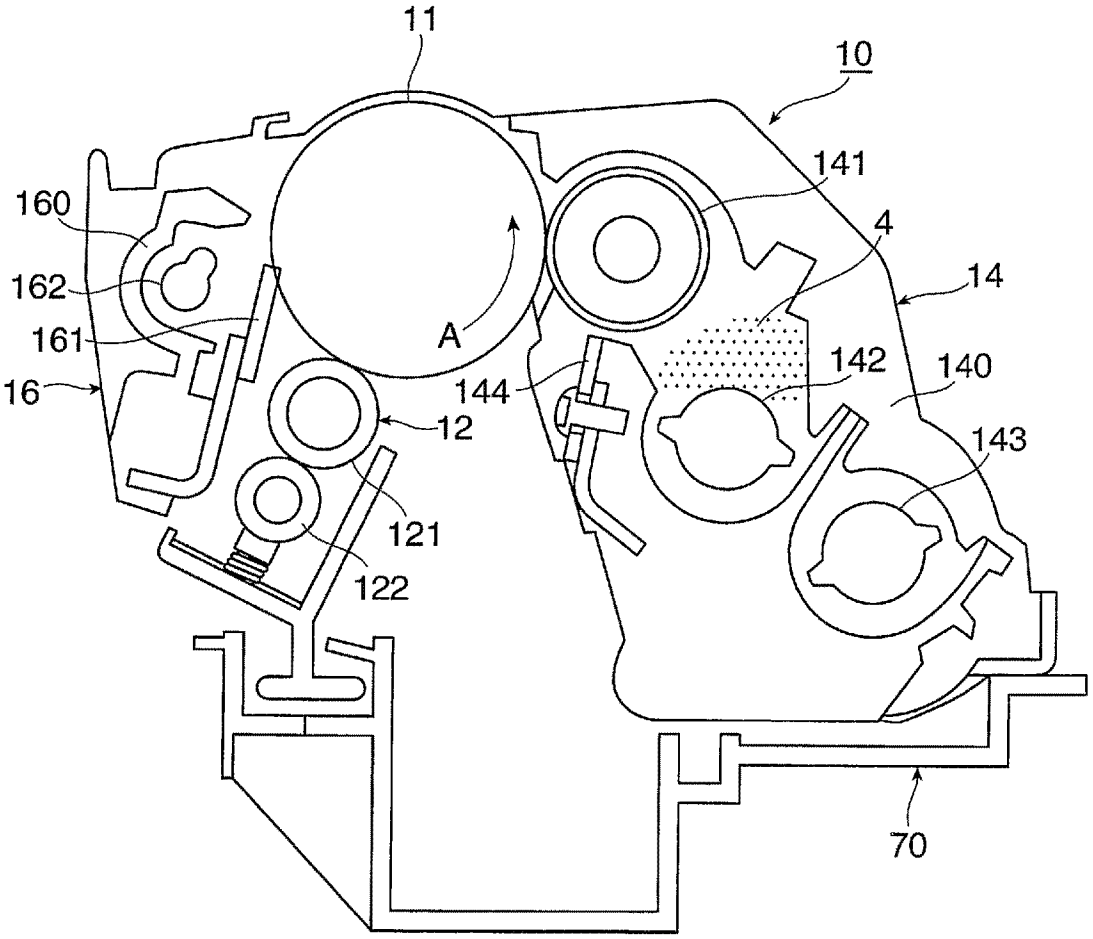
FIG. 2 is a schematic diagram illustrating an image forming unit included in the image forming apparatus according to the exemplary embodiment of the present invention.

FIGS. 1 and 2 illustrate an image forming apparatus 1 including a cleaning member and a charging device according to the exemplary embodiment. FIG. 1 illustrates the overall structure of the image forming apparatus 1. FIG. 2 is an enlarged view of a section of the image forming apparatus 1 including an image forming device.

Overall Structure of Image Forming Apparatus

The image forming apparatus 1 according to the exemplary embodiment is, for example, a color printer. The image forming apparatus 1 includes plural image forming devices 10, an intermediate transfer device 20, a sheet feeding device 30, and a fixing device 40. Each image forming device 10 is an example of an image forming unit that forms a toner image by using toner contained in developer 4. The intermediate transfer device 20 carries the toner images formed by the image forming devices 10 and transports the toner images to a second transfer position, at which the toner images are transferred onto a recording paper sheet 5, which is an example of a recording medium, in a second transfer process. The sheet feeding device 30 stores recording paper sheets 5 to be supplied to the second transfer position of the intermediate transfer device 20, and transports each recording paper sheet 5. The fixing device 40 fixes the toner images that have been transferred onto the recording paper sheet 5 by the intermediate transfer device 20 in the second transfer process. Referring to FIG. 1, the image forming apparatus 1 includes an apparatus body 1*a*. The apparatus body 1*a* is formed of a support structure including frames or an exterior cover. The dashed lines in FIG. 1 show transport paths along which each recording paper sheet 5 is transported in the apparatus body 1*a*.

The image forming devices 10 include four image forming devices 10Y, 10M, 10C, and 10K, which exclusively form a yellow (Y) toner image, a magenta (M) toner image, a cyan (C) toner image, and a black (K) toner image, respectively. The four image forming devices 10 (Y, M, C, and K) are arranged along an inclined line in the apparatus body 1*a*. The four image forming devices 10 (Y, M, C, and K) are arranged so that the yellow (Y) image forming device 10Y is disposed at a relatively high position in the vertical direction and the black (K) image forming device 10K is disposed at a relatively low position in the vertical direction.

As illustrated in FIGS. 1 and 2, each of the four image forming devices 10 (Y, M, C, and K) include a rotating photoconductor drum 11, which is an example of an image carrier, and devices arranged around the photoconductor drum 11 as examples of toner-image-forming units. These devices include a charging device 12 according to the present exemplary embodiment, an exposure device 13, a developing device 14 (Y, M, C, K), a first transfer device 15 (Y, M, C, K), and a drum cleaning device 16 (Y, M, C, K). The charging device 12 charges a peripheral surface (image carrying surface) of the photoconductor drum 11, which allows an image to be formed thereon, to a certain potential. The exposure device 13 is an example of an electrostatic-latent-image-forming unit that forms an electrostatic latent image (of the corresponding color) having a potential difference by irradiating the charged peripheral surface of the photoconductor drum 11 with light based on image information (signal). The developing device 14 (Y, M, C, K) is an example of a developing unit that develops the electrostatic latent image into a toner image by using the toner contained in the developer 4 of the corresponding color (Y, M, C, K). The first transfer device 15 (Y, M, C, K) is an example of a first transfer unit that performs a first transfer process in which the toner image is transferred to the intermediate transfer device 20. The drum cleaning device 16 (Y, M, C, K) cleans the image carrying surface of the photoconductor drum 11 by removing residual toner and other deposits from the image carrying surface after the first transfer process. In FIG. 1, only the photoconductor drum 11, the charging device 12, etc., of the yellow (Y) image forming device 10Y are denoted by the reference numerals, and reference numerals for the devices of the other image forming devices 10 (M, C, and K) are omitted.

The photoconductor drum 11 is obtained by forming an image carrying surface having a photoconductive layer made of a photosensitive material (photosensitive layer) on the peripheral surface of a hollow or solid cylindrical base that is grounded. This photoconductor drum 11 is supported so as to be rotatable in the direction of arrow A when a driving force is transmitted thereto from a driving device (not shown).

The charging device 12 includes a contact charging roller 121 that is arranged so as to be in contact with the photoconductor drum 11. The charging device 12 also includes a cleaning roller 122, which serves as a cleaning member according to the present exemplary embodiment and cleans the surface of the charging roller 121. A charging voltage is supplied to the charging device 12. In the case where the developing device 14 performs a reversal development, a voltage having the same polarity as the charge polarity of the toner supplied from the developing device 14 is supplied as the charging voltage. The charging device 12 will be described in detail below.

The exposure device 13 is an LED print head including plural light emitting diodes (LEDs), which are light emitting devices, arranged in the axial direction of the photoconductor drum 11. The LED print head forms an electrostatic latent image by irradiating the photoconductor drum 11 with light corresponding to the image information emitted from the LEDs. The exposure device 13 may instead be configured to perform deflection scanning so that the photoconductor drum 11 is scanned with laser light that corresponds to the image information in the axial direction.

As illustrated in FIG. 2, each developing device 14 (Y, M, C, K) includes a developing roller 141, two stirring transport members 142 and 143, and a layer-thickness regulating member 144, which are disposed in a housing 140 having an opening and a storage chamber for the developer 4. The developing roller 141 carries the developer 4 and transports the developer 4 to a developing region in which the developing roller 141 faces the photoconductor drum 11. The stirring transport members 142 and 143 are, for example, screw augers that transport the developer 4 while stirring the developer 4 so that the developer 4 passes the developing roller 141. The layer-thickness regulating member 144 regulates the amount (layer thickness) of the developer 4 carried by the developing roller 141. A developing bias voltage is applied between the developing roller 141 of the developing device 14 and the photoconductor drum 11 by a power supply device (not shown). The developing roller 141 and the stirring transport members 142 and 143 receive a driving force from a driving device (not shown) and rotate in certain directions. A two-component developer, which contains non-magnetic toner and magnetic carrier, are used as the developer 4 of each of the four colors (Y, M, C, and K). The toner contains toner particles and external additives having a diameter smaller than that of the toner particles. The external additives are added, for example, to the surfaces of the toner particles to adjust the chargeability and releasability of the toner.

Each first transfer device 15 (Y, M, C, and K) is a contract transfer device including a first transfer roller which rotates while being in contact with the periphery of the photoconductor drum 11 with the intermediate transfer belt 21 interposed therebetween and to which a first transfer voltage is supplied. The first transfer voltage is a direct-current voltage having a polarity opposite to the charge polarity of the toner, and is supplied by the power supply device (not shown).

As illustrated in FIG. 2, the drum cleaning device 16 includes a container body 160 that has an opening, a cleaning plate 161, and a transport member 162. The cleaning plate 161 is pressed against the peripheral surface of the photoconductor drum 11 at a certain pressure after the first transfer process, and cleans the peripheral surface by removing residual toner and other deposits therefrom. The transport member 162 is, for example, a screw auger that collects the deposits, such as toner, removed by the cleaning plate 161 and transports the collected deposits toward a collection system (not shown). The cleaning plate 161 is, for example, a plate-shaped member (for example, a blade) made of a material such as rubber.

As illustrated in FIG. 1, the intermediate transfer device 20 is disposed above the image forming devices 10 (Y, M, C, and K). The intermediate transfer device 20 includes an intermediate transfer belt 21, plural belt support rollers 22 to 25, a second transfer device 26, and a belt cleaning device 27. The intermediate transfer belt 21 rotates in the direction of arrow B while passing through first transfer positions, which are positions between the photoconductor drums 11 and the first transfer devices 15 (first transfer rollers). The belt support rollers 22 to 25 retain the support the intermediate transfer belt 21 in a desired state and support the intermediate transfer belt 21 in a rotatable manner at the inner surface of the intermediate transfer belt 21. The second transfer device 26 is disposed so as to oppose the outer peripheral surface (image carrying surface) of a portion of the intermediate transfer belt 21 that is supported by the belt support roller 22. The second transfer device 26 is an example of a second transfer unit that performs a second transfer process in which the toner images on the intermediate transfer belt 21 are transferred onto the recording paper sheet 5. The belt cleaning device 27 cleans the outer peripheral surface of the intermediate transfer belt 21 by removing residual toner, paper dust, and other deposits from the outer peripheral surface of the intermediate transfer belt 21 after the intermediate transfer belt 21 has passed the second transfer device 26.

The intermediate transfer belt 21 may be, for example, an endless belt made of a material obtained by dispersing a resistance adjuster, such as carbon black, into a synthetic resin, such as a polyimide resin or a polyamide resin. The belt support roller 22 serves as a second-transfer back support roller. The belt support roller 23 serves as a driving roller that is rotated by a driving device (not shown). The belt support roller 24 serves as a surface positioning roller that enables the intermediate transfer belt 21 to form an image forming surface. The belt support roller 25 serves as a tension-applying roller that applies a tension to the intermediate transfer belt 21.

Referring to FIG. 1, the second transfer device 26 is a contact transfer device including a second transfer roller that rotates while being in contact with the peripheral surface of the intermediate transfer belt 21 at a second transfer position. The second transfer position is the position of the outer peripheral surface of the portion of the intermediate transfer belt 21 that is supported by the belt support roller 22 of the intermediate transfer device 20. A second transfer voltage, which is a direct-current voltage having a polarity that is the same as or opposite to the charge polarity of the toner, is supplied to the second transfer roller or the support roller 22 of the intermediate transfer device 20 by the power supply device (not shown).

As illustrated in FIG. 1, the belt cleaning device 27 includes a container body 270 that has an opening, a cleaning plate 271, and a transport member 272. The cleaning plate 271 is pressed against the peripheral surface of the intermediate transfer belt 21 at a certain pressure after the second transfer process, and cleans the peripheral surface by removing residual toner and other deposits therefrom. The transport member 272 is, for example, a screw auger that collects the deposits, such as toner, removed by the cleaning plate 271 and transports the collected deposits toward a collecting device (not shown). The cleaning plate 271 is, for example, a plate-shaped member (for example, a blade) made of a material such as rubber.

The fixing device 40 includes a heating rotational body 41 and a pressing rotational body 42, which are disposed in a housing (not shown) having an inlet and an outlet for the recording paper sheet 5. The heating rotational body 41 is roller-shaped or belt-shaped, and rotates in the direction indicated by the arrow while being heated by a heating unit so that the surface temperature thereof is maintained at a predetermined temperature. The pressing rotational body 42 is roller-shaped or belt-shaped, and rotates while being pressed against the heating rotational body 41 substantially along the axial direction at a predetermined pressure. A contact section in which the heating rotational body 41 and the pressing rotational body 42 of the fixing device 40 are in contact with each other serves as a fixing process section that performs a certain fixing process (heating and pressing).

The sheet feeding device 30 is disposed vertically below the image forming devices 10 (Y, M, C, and K). The sheet feeding device 30 includes one or more sheet containers 31 that contain the recording paper sheets 5 of desired size, type, etc., in a stacked manner, and feeding devices 32 that feed the recording paper sheets 5 one at a time from the sheet containers 31. The sheet containers 31 are attached to the apparatus body 1*a* so as to be capable of being pulled out along guide rails (not shown) at the front side of the apparatus body 1*a*, which faces the user when the user operates the apparatus. In this exemplary embodiment, the near side in the direction perpendicular to the plane of FIG. 1 is defined as the front side of the apparatus body 1*a*.

Examples of the recording paper sheets 5 include thin paper sheets, such as sheets of normal paper and tracing paper used in electrophotographic copy machines and printers, and OHP sheets. The smoothness of the image surfaces after the fixing process may be increased by making the surfaces of the recording paper sheets 5 as smooth as possible. Accordingly, for example, sheets of coated paper obtained by coating the surface of normal paper with resin or the like and so-called cardboard paper, such as art paper for printing, that has a relatively large basis weight may be used.

As illustrated in FIG. 1, one or more sheet transport roller pairs 33, which transport each recording paper sheet 5 fed from the sheet feeding device 30 to the second transfer position, and a sheet transport path 34, which includes transport guides (not shown), are arranged in the vertical direction between the sheet feeding device 30 and the second transfer device 26 at the left side of the apparatus body 1*a*. The sheet transport roller pair 33 provided on the sheet transport path 34 at a location immediately in front of the second transfer position serves as, for example, a pair of rollers that adjust the time at which the recording paper sheet 5 is transported (registration rollers). A sheet transport path 35 is provided between the second transfer device 26 and the fixing device 40. The recording paper sheet 5 fed from the second transfer device 26 after the second transfer process is transported to the fixing device 40 along the sheet transport path 35. A first discharge transport path 39 and a second discharge transport path 45 are disposed near paper discharge openings formed in the apparatus body 1*a* of the image forming apparatus 1. The first discharge transport path 39 is provided with a first paper discharge roller pair 38 that discharges the recording paper sheet 5 to a first paper discharge portion 37, which is disposed in an upper section of the image forming apparatus body 1*a*, after the recording paper sheet 5 is subjected to the fixing process and transported from the fixing device 40 by an exit roller 36. The second discharge transport path 45 is provided with a second paper discharge roller pair 44 that discharges the recording paper sheet 5 to a second paper discharge portion 43, which is disposed above the first paper discharge portion 37. The second discharge transport path 45 is also provided with a third paper discharge roller pair 47 that discharges the recording paper sheet 5 to a third paper discharge portion 46, which is disposed on the left side surface of the apparatus body 1*a*, after the discharge direction of the recording paper sheet 5 is switched by a first switching gate G1. The third paper discharge portion 46 is a so-called face-up tray on which the recording paper sheet 5 is discharged with the image surface facing upward.

A second switching gate G2, which switches between sheet transport paths, is disposed between the fixing device 40 and the first paper discharge roller pair 38. The rotation direction of the first paper discharge roller pair 38 is switchable between the forward direction (discharging direction) and the reverse direction. When images are to be formed on both sides of the recording paper sheet 5, the rotation direction of the first paper discharge roller pair 38 is switched from the forward direction (discharging direction) to the reverse direction after the trailing end of the recording paper sheet 5 having an image formed on one side thereof has passed the second switching gate G2. When the recording paper sheet 5 is transported in the reverse direction by the first paper discharge roller pair 38, the second switching gate G2 switches the transport path of the recording paper sheet 5 so that the recording paper sheet 5 is transported to a double-sided-printing transport path 48, which extends substantially vertically along a side surface of the apparatus body 1*a*. The double-sided-printing transport path 48 is provided with a sheet transport roller pair 49 and a transport guide (not shown) for transporting the recording paper sheet 5 to the sheet transport roller pair 33 in a reversed state. A sheet transport roller pair 49a is provided to transport the recording paper sheet 5 to the sheet transport roller pair 33 when the recording paper sheet 5 is supplied from a sheet container 31 disposed in a lower section or from a manual feed tray.

Referring to FIG. 1, toner cartridges 145 (Y, M, C, and K) are arranged so as to extend in the direction perpendicular to the plane of FIG. 1. Each of the toner cartridges 145 (Y, M, C, and K) stores developer, which contains at least toner, to be supplied to a corresponding one of the developing devices 14 (Y, M, C, and K). In the present exemplary embodiment, the developer 4, which is a mixture of toner and carrier, is stored in each of the toner cartridges 145 (Y, M, C, and K).

In addition, referring to FIG. 1, a guide member 70 guide the yellow (Y), magenta (M), cyan (C), and black (K) image forming devices 10Y, 10M, 10C, and 10K, which are formed as units, so that they are removably attachable to the apparatus body 1*a*.

In addition, referring to FIG. 1, a control device 200 performs centralized control of the image forming apparatus 1. The control device 200 includes a central processing unit (CPU), a read only memory (ROM), a random access memory (RAM), a bus that connects the CPU, ROM, etc., and a communication interface which provides communication with an external device. All of these components are not illustrated.

Operation of Image Forming Apparatus

A basic image forming operation performed by the image forming apparatus 1 will now be described.

A full-color-mode operation for forming a full-color image by combining toner images of four colors (Y, M, C, and K) by using the four image forming devices 10 (Y, M, C, and K) will be described.

The image forming apparatus 1 is controlled by the control device 200. When the image forming apparatus 1 receives command information of a request for a full-color image forming operation (printing) from, for example, a user interface or a printer driver (not shown), the four image forming devices 10 (Y, M, C, and K), the intermediate transfer device 20, the second transfer device 26, and the fixing device 40 are activated.

As illustrated in FIGS. 1 and 2, in each of the image forming devices 10 (Y, M, C, and K), the photoconductor drum 11 rotates in the direction of arrow A, and the charging device 12 charges the surface of the photoconductor drum 11 to a certain potential of a certain polarity (negative in the exemplary embodiment). Subsequently, the exposure device 13 irradiates the charged surface of the photoconductor drum 11 with light emitted on the basis of an image signal obtained by converting the image information input to the image forming apparatus 1 into components of the respective colors (Y, M, C, and K). Thus, an electrostatic latent image of the corresponding color having a certain potential difference is formed on the surface of the photoconductor drum 11.

Subsequently, the image forming devices 10 (Y, M, C, and K) develop the electrostatic latent images of the respective colors formed on the photoconductor drums 11 by supplying toners of the respective colors (Y, M, C, and K), which are charged to a certain polarity (negative polarity), from the developing rollers 141 and causing the toners to electrostatically adhere to the photoconductor drums 11. Accordingly, the electrostatic latent images of the respective colors formed on the photoconductor drums 11 are developed by the toners of the respective colors and made visible as toner images of the four colors (Y, M, C, and K).

Subsequently, when the toner images of the respective colors formed on the photoconductor drums 11 of the image forming devices 10 (Y, M, C, and K) reach the first transfer positions, the first transfer devices 15 (Y, M, C, and K) perform the first transfer process in which the toner images of the respective colors are successively transferred onto the intermediate transfer belt 21, which is included in the intermediate transfer device 20 and rotates in the direction of arrow B, in a superposed manner.

After the first transfer process, the drum cleaning device 16 of each of the image forming devices 10 (Y, M, C, and K) cleans the surface of the photoconductor drum 11 by scraping off deposits therefrom. Thus, the image forming devices 10 (Y, M, C, and K) are made ready for the next image forming operation. However, the deposits, such as the toner and external additives of the toner, may not be completely removed by the drum cleaning device 16, and may remain on the surface of the photoconductor drum 11. The deposits, such as the toner and external additives of the toner, that have not been removed by the drum cleaning device 16 are moved to the charging device 12 by the rotation of the photoconductor drum 11.

Subsequently, the intermediate transfer belt 21 of the intermediate transfer device 20 rotated while carrying the toner images, which have been transferred thereto in the first transfer process, to move the toner images to the second transfer position. The sheet feeding device 30 feeds the recording paper sheet 5 toward the sheet transport path 34 in accordance with the image forming operation. The sheet transport roller pair 33, which is a pair of registration rollers, transports the recording paper sheet 5 to the second transfer position along the sheet transport path 34 in accordance with the transfer time.

The toner images on the intermediate transfer belt 21 are simultaneously transferred onto the recording paper sheet 5 in the second transfer process performed by the second transfer device 26 at the second transfer position. After the second transfer process, the belt cleaning device 27 of the intermediate transfer device 20 cleans the surface of the intermediate transfer belt 21 by removing residual toner and other deposits therefrom.

Subsequently, the recording paper sheet 5 to which the toner images have been transferred in the second transfer process is removed from the intermediate transfer belt 21 and transported to the fixing device 40 along the sheet transport path 35. The fixing device 40 causes the recording paper sheet 5 that has been subjected to the second transfer process to path through the contact section between the heating rotational body 41 and the pressing rotational body 42 that rotate, and fixes the unfixed toner images to the recording paper sheet 5 by performing a necessary fixing process (heating and pressing). Finally, when an image is to be formed only on one side of the recording paper sheet 5 in the image forming operation, the recording paper sheet 5 that has been subjected to the fixing process is discharged to, for example, the first paper discharge portion 37 in the upper section of the apparatus body 1*a* by the first paper discharge roller pair 38.

As a result of the above-described operation, the recording paper sheet 5 having a full-color image, which is formed by combining the toner images of the four colors, formed thereon is output. The image forming apparatus 1 may, of course, instead form a monochrome image on the recording paper sheet 5 by using only the black (K) image forming device 10K.

Structure of Charging Device and Cleaning Member

Figure 3:
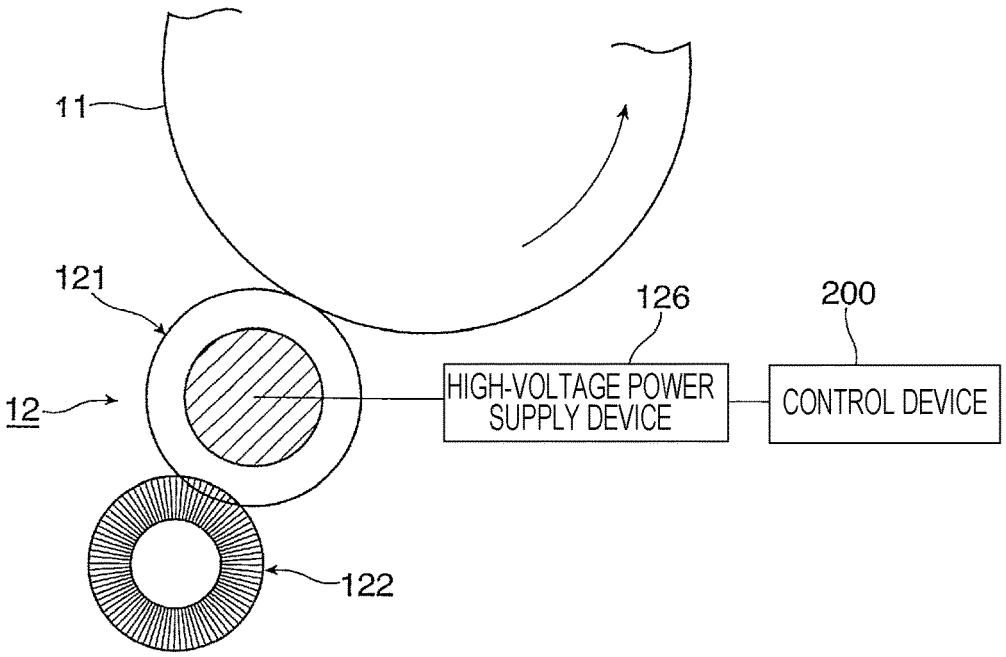
FIG. 3 is a schematic diagram illustrating the charging device including the cleaning member according to the exemplary embodiment of the present invention.
Figure 4:
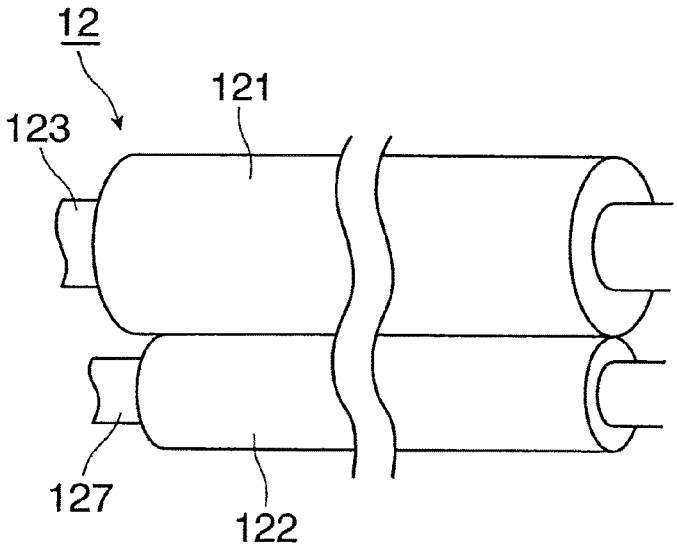
FIG. 4 is a perspective view of the charging device according to the exemplary embodiment of the present invention.

FIGS. 3 and 4 are a sectional view and a perspective view, respectively, of the charging device according to the present exemplary embodiment.

As illustrated in FIGS. 3 and 4, the charging device 12 includes a charging roller 121, which is an example of a roller-shaped charging member, and a cleaning roller 122, which is an example of a cleaning member. The charging roller 121 is in contact with the peripheral surface of the photoconductor drum 11, which serves an object to be charged. A charging voltage is applied between the charging roller 121 and the photoconductor drum 11. The cleaning roller 122 is in contact with the peripheral surface of the charging roller 121 in a region where the charging roller 121 is not in contact with the photoconductor drum 11, and cleans the surface of the charging roller 121.

Figure 5A:
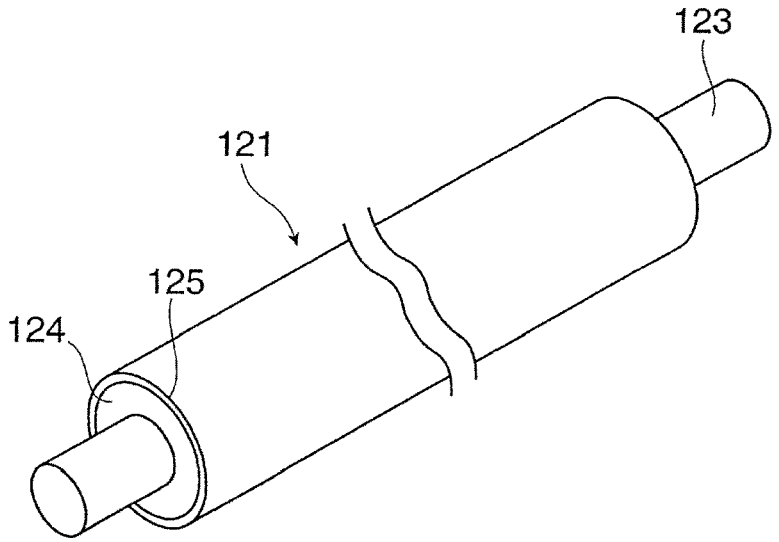
FIGS. 5A and 5B are a perspective view and a sectional view, respectively, of a charging roller.
Figure 5B:
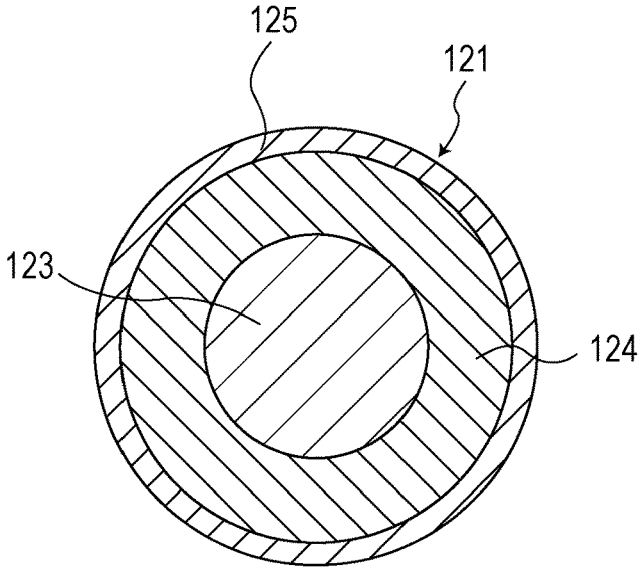

As illustrated in FIGS. 5A and 5B, the charging roller 121 includes a cylindrical core bar 123 made of a metal, such as stainless steel or iron; an elastic layer 124 having a certain thickness that covers the outer periphery of the core bar 123 and to which conductivity is imparted; and a surface layer 125 that covers the surface of the elastic layer 124. The core bar 123 projects at both ends of the charging roller 121 in the axial direction, and serves also as a rotating shaft. The end portions of the core bar 123 of the charging roller 121 in the axial direction are rotatably supported by conductive bearings (not shown). As illustrated in FIG. 3, the core bar 123 of the charging roller 121 is connected to a high-voltage power supply device 126 (example of a voltage applying device) via the bearings (not shown). The control device 200 controls the value and application timing of the high-voltage to be applied to the charging roller 121 by the high-voltage power supply device 126.

The elastic layer 124 is made of, for example, a porous foam material having hollow holes in the inner region thereof and projections and recesses on the surface thereof. The elastic layer 124 is formed so as to have a certain resistance value by dispersing a resistance adjuster, such as carbon black or an ionic conductive agent, into a foamable resin material or a foamable rubber material. Examples of the foamable resin material include polyurethanes, polyethylenes, polyamides, olefins, melamines, and polypropylenes. Examples of the foamable rubber material include ethylene-propylene-diene copolymer rubber (EPDM), acrylonitrile-butadiene copolymer rubber (NBR), styrene-butadiene rubbers, chloroprene rubbers, silicone rubbers, nitrile rubbers, and natural rubbers. The elastic layer 124 may instead be a solid rubber that is not foamed.

Figure 6:
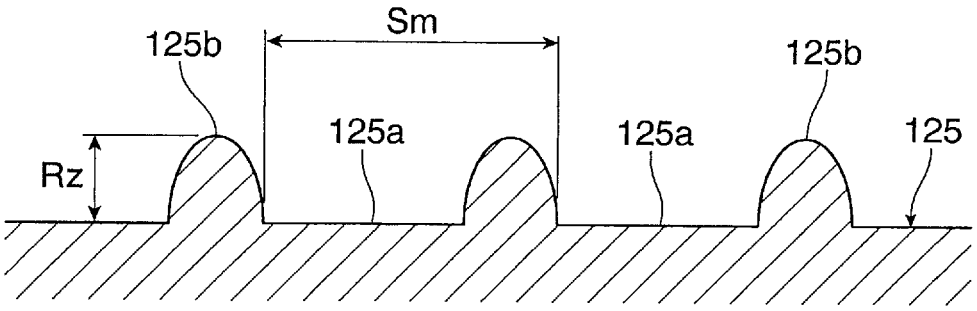
FIG. 6 is an enlarged schematic view of a surface of the charging roller.

The surface layer 125 of the charging roller 121 is formed by coating the outer peripheral surface of the elastic layer 124 with a material in which filler particles are dispersed. As illustrated in FIG. 6, the surface layer 125 has an irregular surface including recesses 125*a* and projections 125*b* formed by the dispersed filler particles. The recesses 125*a* and projections 125*b* are not arranged at predetermined positions in the axial and circumferential directions of the charging roller 121, but are, of course, irregularly distributed in the axial and circumferential directions of the charging roller 121. Although FIG. 6 shows the recesses 125*a* that are flat for convenience, the recesses 125*a* may, of course, instead be curved. The gaps and height differences between the recesses 125*a* and projections 125*b* formed on the surface of the surface layer 125 are adjusted by changing the diameter and amount of filler particles to be dispersed.

The surface layer 125 on the elastic layer 124 of the charging roller 121 may be omitted. In such a case, a filler may be dispersed in the elastic layer 124, which defines the outer surface of the charging roller 121. Alternatively, the elastic layer 124 may be formed of a foam material having hollow holes, projections and recesses so that the elastic layer 124 has an irregular surface.

Referring to FIG. 6, in a roughness curve that shows the measured cross-sectional shape of the surface of the charging roller 121 according to the exemplary embodiment, the average distance Sm between adjacent recesses and projections is about 70 μm, and the maximum height roughness Rz is about 10 μm.

Figure 7:
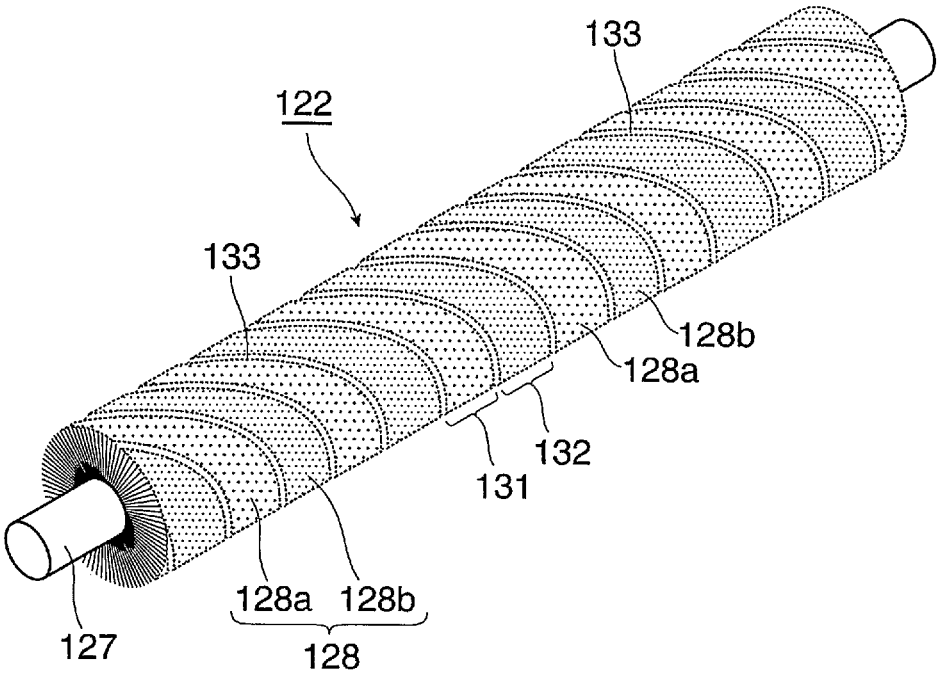
FIG. 7 is a perspective view of a cleaning roller.

The cleaning roller 122 is a member for cleaning the surface of the charging roller 121. As illustrated in FIG. 7, the cleaning roller 122 includes a core bar 127, which is an example of a brush base and which is made of a metal, such as stainless steel or iron, and many (plural) bristles 128 that are attached to the outer periphery of the core bar 127 so as to be densely arranged at a certain density. The tips of the bristles 128 come into contact with the charging roller 121, which serves an object to be cleaned, having an irregular surface. The bristles 128 are attached to the outer periphery of the core bar 127 at a certain density by, for example, electrostatic flocking. The core bar 127 projects at both ends of the cleaning roller 122 and serves also as a rotating shaft. The end portions of the core bar 127 of the cleaning roller 122 in the axial direction are rotatably supported by conductive bearings (not shown). A certain voltage is applied to the core bar 127 of the cleaning roller 122 via the bearings (not shown). Alternatively, the core bar 127 may be connected to ground via a high resistance, or floated instead of being grounded.

The cleaning roller 122 is arranged to be in contact with the surface of the charging roller 121, which is an example of an object to be cleaned, along the axial direction. The cleaning roller 122 may be a driven roller that is rotated at the same speed (peripheral speed) as that of the charging roller 121 by coming into contact with the surface of the charging roller 121. Alternatively, the cleaning roller 122 may be rotated by a driving-force transmission mechanism, such as a gear, at a speed different from that of the charging roller 121. The cleaning roller 122 is pressed against the surface of the charging roller 121 by an elastic member, such as a coil spring (not shown), with a certain pressing force. The cleaning roller 122 may instead be pressed against the surface of the charging roller 121 by a member that is not elastic (not shown) with a certain pressing force so that the distance between the axes of the cleaning roller 122 and the charging roller 121 is maintained constant.

The bristles 128 are formed of fibers made of, for example, nylon or polyester. The material of the bristles 128 is not limited to nylon or polyester, and may instead be another material. The bristles 128 at least include bristles having a non-circular cross-section which includes a projecting portion that projects toward the outer periphery and that has a size such that the projecting portion is capable of entering the recesses 125*a* in the surface of the charging roller 121.

Figure 8:
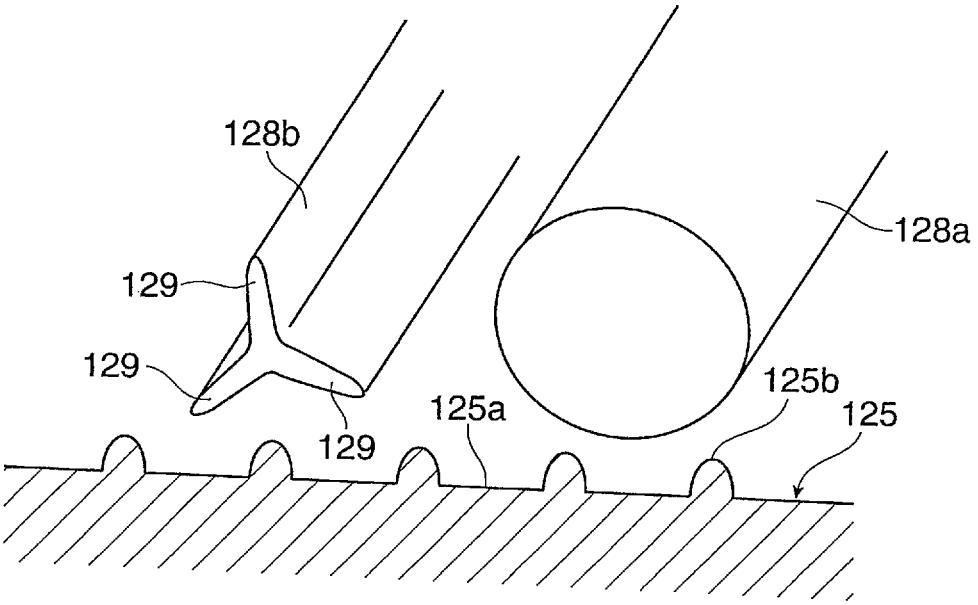
FIG. 8 is an enlarged schematic view of portions of the cleaning roller.

In this exemplary embodiment, the bristles 128 include at least two types of bristles having different outer diameters and cross-sectional shapes. Referring to FIG. 8, each of first bristles 128*a*, which are one of the two types of bristles, has a thickness such that the first bristle 128*a* cannot reach the bottoms of the recesses 125*a* included in the irregular surface of the charging roller 121. Each of second bristles 128*b*, which are the other of the two types of bristles, has a non-circular cross-section which includes at least one projecting portion that projects toward the outer periphery (plural projecting portions are provided in the illustrated example). At least the projecting portion has a size such that the projecting portion is capable of entering the recesses 125*a* in the charging roller 121. The cleaning roller 122 may include only the second bristles 128*b*.

Figure 9A:
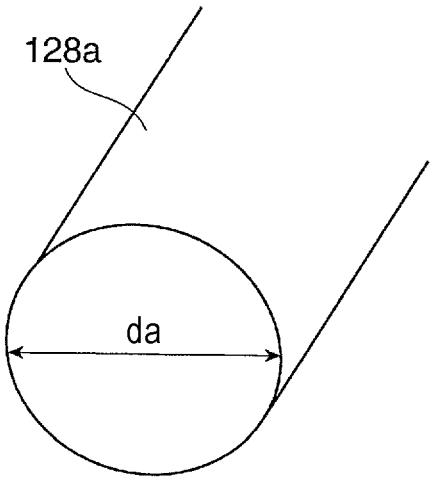
FIGS. 9A and 9B are schematic diagrams illustrating a first bristle and a second bristle, respectively.

As illustrated in FIG. 9A, each first bristle 128*a* has a circular cross-section. The thickness (diameter) da of the first bristle 128*a* is, for example, set to about 80 μm (50 denier). The thickness (diameter) da of the first bristle 128*a* may be larger or smaller than 80 μm (50 denier). However, the thickness is set so that the first bristle 128*a* cannot reach the bottoms of the recesses 125*a* included in the irregular surface of the charging roller 121.

Figure 9B:
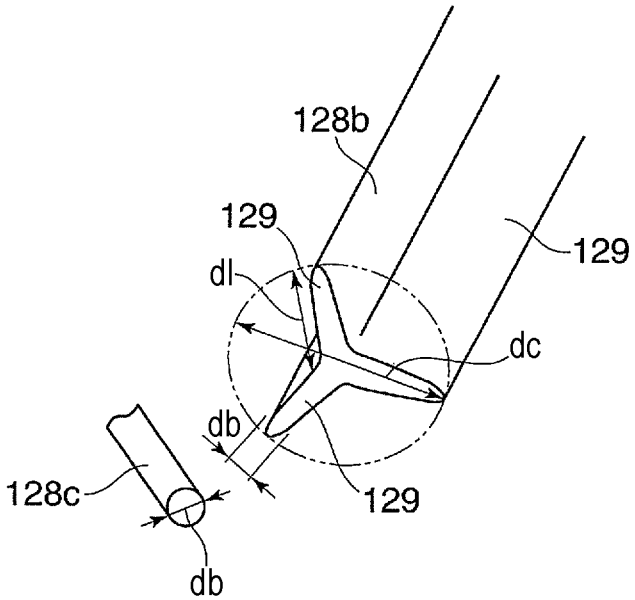

As illustrated in FIG. 9B, each second bristle 128*b* has a non-circular cross-section, such as a substantially Y-shaped cross-section. More specifically, each second bristle 128*b* has a non-circular cross-section which includes at least one projecting portion 129 that projects radially outward (toward the outer periphery) from the center (plural projecting portions 129 are provided in the illustrated example). The projecting portions 129 substantially form a "Y" shape with an angle of about 120 degrees therebetween in the circumferential direction. The projecting portions 129 have a size such that the projecting portions 129 are capable of entering the recesses 125*a* in the charging roller 121 and reaching the bottoms of the recesses 125*a*. More specifically, when db is a maximum width of the projecting portions 129 of the second bristle 128*b* in cross-section and dl is a projecting length of the projecting portions 129, the projecting portions 129 satisfy the following expressions:

$$Sm>db, \text{ and } Rz<dl$$

As described above, Sm is the average distance between adjacent recesses 125*a* and projections 125*b*, and Rz is the maximum height roughness from the bottoms of the recess 125*a* to the apexes of the projections 125*b* in a roughness curve that shows the cross-sectional shape of the surface of the charging roller 121.

The second bristle 128*b* is, for example, 30 denier. When the tip of each projecting portion is approximated by a circle, the diameter of the circle (which corresponds to the width db of the tip) is about 8 μm. The diameter of the circumcircle of the second bristle 128*b* is about 100 μm. The thickness (diameter) dc of the second bristle 128*b* may be greater or smaller than about 100 μm. However, each projecting portion 129 of the second bristle 128*b* has a size such that the projecting portion 129 is capable of entering the recesses 125*a* in the charging roller 121 and reaching the bottoms of the recesses 125*a*. The thickness (diameter) dc of the second bristle 128*b* may either be such that the second bristle 128*b* cannot enter the recesses 125*a* in the charging roller 121 or such that the second bristle 128*b* is capable of entering the recesses 125*a* in the charging roller 121.

Referring to FIG. 9B, the rigidity of each projecting portion 129 of the second bristle 128*b* is higher than that of a bristle 128*c* having a circular cross-section with an outer diameter equal to the maximum width db of the projecting portion 129.

In addition, referring to FIG. 9B, the rigidity of the second bristle 128*b* may be higher than that of a bristle having a circular cross-section with an outer diameter equal to the diameter dc of the second bristle 128*b*.

Figure 10A:
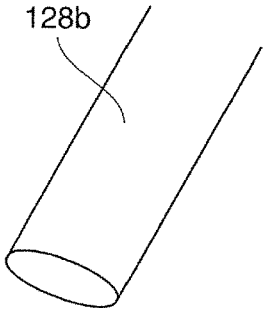
FIGS. 10A, 10B, and 10C are schematic diagrams illustrating modifications of the second bristle.
Figure 10B:
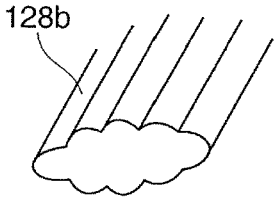
Figure 10C:
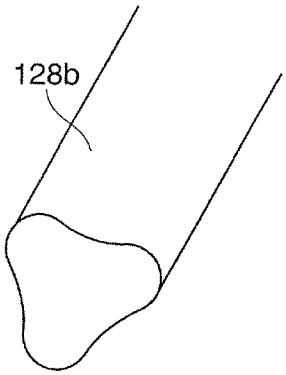

Referring to FIGS. 10A to 10C, the second bristle 128*b* may have, for example, an elongated cross-section, an elongated multifoliate cross-section, which is a cross-section of a fiber having an elongated cross-section with an irregular surface, or a substantially triangular cross-section instead of the substantially Y-shaped cross-section. An example of the bristle 128*b* having a substantially Y-shaped cross-section illustrated in FIG. 9B is a quick-absorption, quick-dry polyester fiber produced by KB Seiren, Ltd. (trade name Soierion). An example of the bristle 128*b* having an elongated cross-section illustrated in FIG. 10A is a polyester fiber produced by KB Seiren, Ltd. (trade name Bellsquare). An example of the bristle 128*b* having an elongated multifoliate cross-section illustrated in FIG. 10B is a polyester fiber produced by Toray Industries, Inc. (trade name Pentas α). An example of the bristle 128*b* having a triangular cross-section illustrated in FIG. 10C is a polyester fiber produced by KB Seiren, Ltd. (trade name Bright Modified).

As illustrated in FIG. 7, the cleaning roller 122 includes a region 131 in which only the first bristles 128*a* are attached and a region 132 in which only the second bristles 128*b* are attached. The region 131 in which only the first bristles 128*a* are attached and the region 132 in which only the second bristles 128*b* are attached are both arranged so as to contact the charging roller 121 over the entire cleaning region thereof in the axial direction of the charging roller 121.

Figure 11:
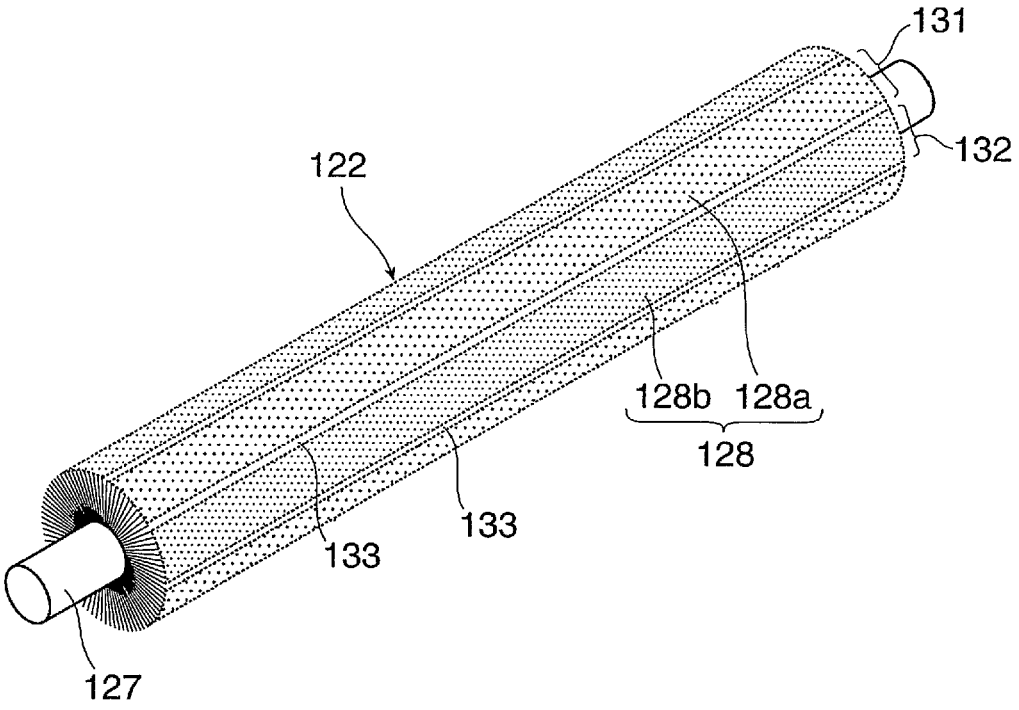
FIG. 11 is a perspective view of a modification of the cleaning roller.

As illustrated in FIG. 7, for example, the region 131 in which only the first bristles 128*a* are attached and the region 132 in which only the second bristles 128*b* are attached may be helically wound around the outer periphery of the core bar 127 with gaps 133 therebetween. The cleaning roller 122 is not limited to this. For example, as illustrated in FIG. 11, the regions 131 in which only the first bristles 128*a* are attached and the regions 132 in which only the second bristles 128*b* are attached may be formed so as to extend over the entire length of the cleaning roller 122 in the axial direction and arranged alternately in the circumferential direction. It is not necessary that the gaps 133 be provided.

The first bristles 128*a* and the second bristles 128*b* may be attached to the outer periphery of the core bar 127 so as to be randomly distributed instead of forming the regions 131 and 132. However, the functions of the first bristles 128*a* and the second bristles 128*b* may be enhanced by arranging the first bristles 128*a* and the second bristles 128*b* in different regions 131 and 132.

Operation of Charging Device and Cleaning Member

As illustrated in FIGS. 1 and 2, in each of the image forming devices 10 (Y, M, C, and K), the photoconductor drum 11 is rotated in the direction of arrow A during an image forming operation, and the charging roller 121 of the charging device 12 according to the present exemplary embodiment contacts the surface of the photoconductor drum 11 and charges the surface to a certain potential of a certain polarity (negative polarity in the exemplary embodiment).

Figure 12A:
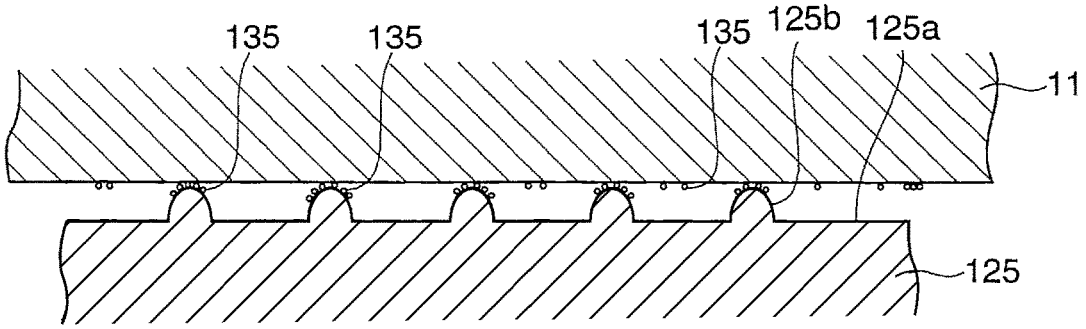
FIGS. 12A and 12B are sectional views illustrating the charging device and a photoconductor drum according to the exemplary embodiment of the present invention.
Figure 12B:
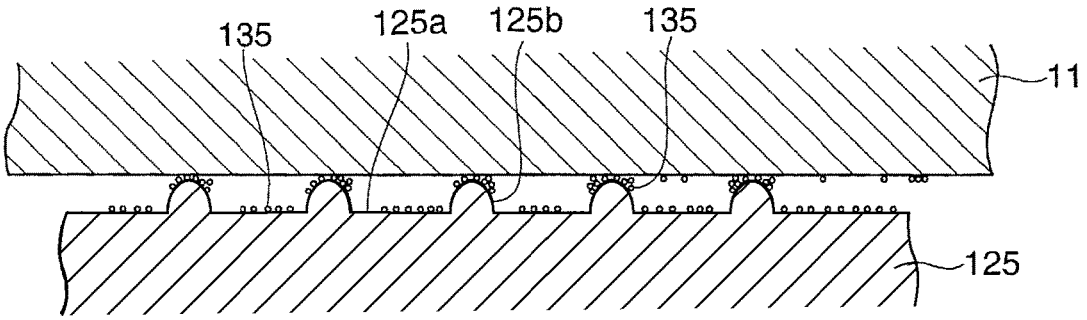

At this time, the surface of the charging roller 121 is in contact with the outer peripheral surface of the photoconductor drum 11. Therefore, as illustrated in FIG. 12A, foreign substances 135, such as the toner and external additives of the toner, that have not been removed by the drum cleaning device 16 and remained on the photoconductor drum 11 adhere to the surface of the charging roller 121. When the charging roller 121 rotates while being in contact with the surface of the photoconductor drum 11, the foreign substances 135, such as the toner and external additives of the toner, that have adhered to the surface of the charging roller 121 are pressed by a pressing force applied between the charging roller 121 and the photoconductor drum 11. Accordingly, a phenomenon called "filming", in which the foreign substances 135 adhere to the projections of the charging roller 121 in the form of films, tends to occur. The recesses 125*a* in the surface of the charging roller 121 do not or do not easily come into direct contact with the surface of the photoconductor drum 11. Therefore, the foreign substances 135, such as the toner and external additives of the toner, do not easily adhere to the recesses 125*a* directly from the surface of the photoconductor drum 11. However, as illustrated in FIG. 12B, the foreign substances 135, such as the toner and external additives of the toner, that have remained on the surface of the photoconductor drum 11 easily fall into the recesses 125*a* in the surface of the charging roller 121 and accumulate when the charging roller 121 rotates while being in contact with the photoconductor drum 11.

Figure 13:
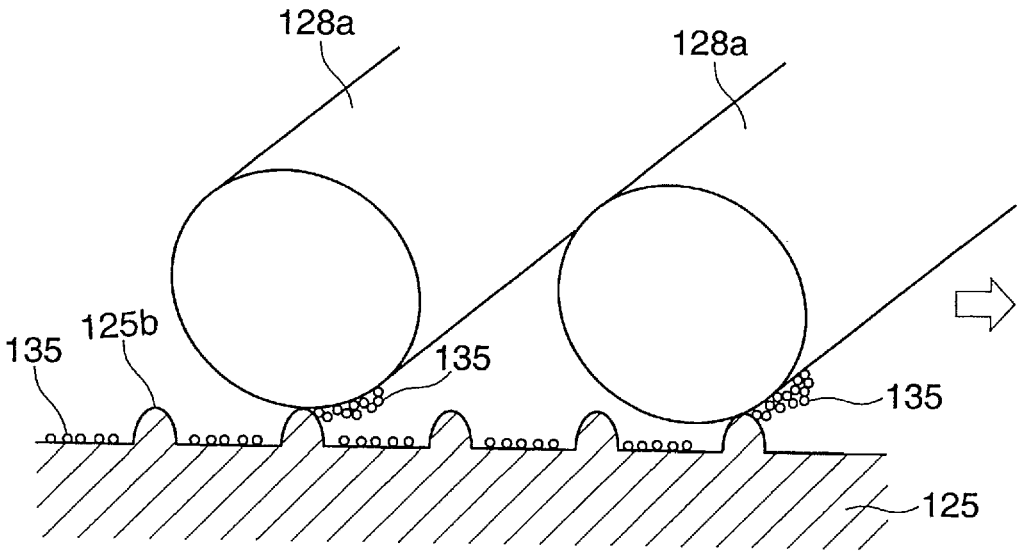
FIG. 13 is a schematic diagram illustrating the operation of the charging device and the cleaning roller according to the exemplary embodiment of the present invention.

In the present exemplary embodiment, as illustrated in FIGS. 3 and 4, the cleaning roller 122 rotates while being in contact with the surface of the charging roller 121. Therefore, the foreign substances 135, such as the toner and external additives of the toner, that have adhered to the projections 125*b* of the charging roller 121 are scraped off basically by the first bristles 128*a* of the cleaning roller 122, as illustrated in FIG. 13. Some of the foreign substances 135, such as the toner and external additives of the toner, that have adhered to the projections 125*b* of the charging roller 121 are removed by the second bristles 128*b* of the cleaning roller 122.

Figure 14:
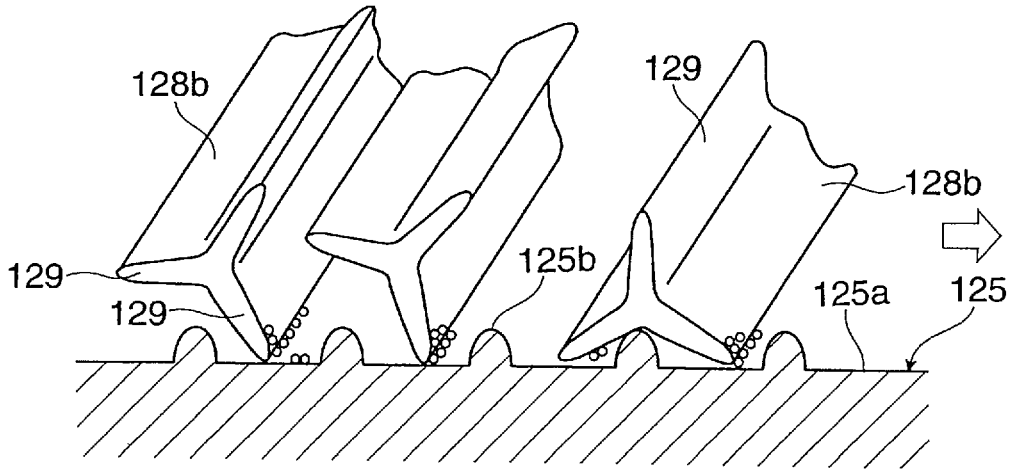
FIG. 14 is a schematic diagram illustrating the operation of the charging device and the cleaning roller according to the exemplary embodiment of the present invention.

As illustrated in FIG. 14, the foreign substances 135, such as the toner and external additives of the toner, that have fallen into the recesses 125*a* in the charging roller 121 and adhered to the recesses 125*a* are scraped off by the projecting portions 129 of the second bristles 128*b* of the cleaning roller 122 when the projecting portions 129 enter the recesses 125*a* in the charging roller 121. The second bristles 128*b* have a non-circular cross-section including the projecting portions 129 that project toward the outer periphery. In addition, the rigidity of each projecting portion 129 is higher than that of a bristle having a circular cross-section with the same outer diameter. Therefore, the foreign substances 135, such as the toner and external additives of the toner, that have fallen into the recesses 125*b* in the charging roller 121 and adhered to the recesses 125*b* are scraped off and effectively removed by the projecting portions 129 of the second bristles 128*b* that enter the recesses 125*a* in the charging roller 121.

More specifically, as illustrated in FIG. 9B, each second bristle 128*b* of the cleaning roller 122 has a non-circular cross-section, and the rigidity of each projecting portion 129 is higher than that of a bristle having a circular cross-section with the same outer diameter. Therefore, as illustrated in FIG. 14, the projecting portions 129 of the second bristles 128*b* that project toward the outer periphery enter the recesses 125*a* in the surface of the charging roller 121 and scrape off the foreign substances 135, such as the toner and external additives, that have adhered to the recesses 125*a* in the charging roller 121. Since the second bristles 128*b* of the cleaning roller 121 have a non-circular cross-section and a relatively high rigidity, the second bristles 128*b* including the projecting portions 129 are not easily elastically deformed when the projecting portions 129 enter the recesses 125*a* in the charging roller 121. Accordingly, the second bristles 128*b* effectively scrape off the foreign substances 135, such as the toner and external additives, that have adhered to the recesses 125*a* in the charging roller 121.

Experimental Examples 1 to 3

To confirm the operation and effects of the cleaning roller according to the present exemplary embodiment, the inventors of the present invention prepare the image forming apparatus 1 including the charging device 12 including the cleaning roller 122 illustrated in FIG. 7 and perform an experiment for confirming the cleaning performance of the cleaning roller 122. A charging roller having an irregular surface formed by adding filler particles to the surface layer 125 is used as the charging roller 121. In the roughness curve that shows the cross-sectional shape of the surface of the charging roller 121, the average distance Sm between adjacent recesses 125*a* and projections 125*b* is 70 μm, and the maximum height roughness Rz is 10 μm. In the cleaning roller 122 of Experimental Example 1, the first bristles 128*a* are nylon fibers having a circular cross-section with a diameter of 80 μm (50 denier). The second bristles 128*b* are 30-denier polyester fibers having a Y-shaped (non-circular) cross-section in which the width and projecting length of each projecting portion 129 are 8 μm and 50 μm, respectively. When the tip of each projecting portion 129 is approximated by a circle, the diameter of the circle is 8 μm. The cleaning roller 122 is configured such that a region in which only the first bristles 128*a* are attached and a region in which only the second bristles 128*b* are attached are helically wound around the outer periphery of the core bar 127.

The cleaning roller 122 of Experimental Example 2 does not include the first bristles 128*a*, and include only the second bristles 128*b*. The second bristles 128*b* are 30-denier polyester fibers having a Y-shaped (non-circular) cross-section in which the width and projecting length of each projecting portion 129 are 8 μm and 50 μm, respectively. When the tip of each projecting portion 129 is approximated by a circle, the diameter of the circle is 8 μm.

The cleaning roller 122 of Experimental Example 3 does not include the first bristles 128*a*, and include only the second bristles 128*b*. The second bristles 128*b* are 30-denier polyester fibers having a triangular (non-circular) cross-section. When the tip of each projecting portion is approximated by a circle, the diameter of the circle is 36 μm.

The cleaning performance of each cleaning roller 122 is evaluated by forming images on 50,000 A4-size recording paper sheets 5 (50 KPV) and checking the occurrence of streaks on a print sample due to contamination of the surface of the charging roller 121 with toner and external additives after the printing operation (50 KPV). The streaks on the print sample are visually evaluated based on a streak sample used in Fuji Xerox Co., Ltd.

In addition, the surface of the charging roller 121 after the printing operation (50 KPV) is observed by using a scanning electron microscope (SEM) to check the state of the toner and external additives on the surface of the charging roller 121.

Cleaning rollers 122 of Comparative Examples are also checked for the occurrence of streaks on the print sample due to contamination of the charging roller 121. A cleaning roller 122 of Comparative Example 1 includes only nylon fibers having a circular cross section with a diameter of 80 μm (50 denier) as the first bristles 128*a*. A cleaning roller 122 of Comparative Example 2 includes nylon fibers having a circular cross section with a diameter of 80 μm (50 denier) as the first bristles 128*a*, and nylon fibers having a circular cross section with a diameter of 28 μm (6 denier) as the second bristles 128*b*. A cleaning roller 122 of Comparative Example 3 includes only nylon fibers having a circular cross section with a diameter of 8 μm (0.5 denier) as the second bristles 128*b*. A cleaning roller 122 of Comparative Example 4 includes only nylon fibers having a circular cross section with a diameter of 10 μm (0.8 denier) as the second bristles 128*b*. A cleaning roller 122 of Comparative Example 5 includes only nylon fibers having a circular cross section with a diameter of 16 μm (2 denier) as the second bristles 128*b*. A cleaning roller 122 of Comparative Example 6 includes only nylon fibers having a circular cross section with a diameter of 28 μm (6 denier) as the second bristles 128*b*.

FIG. 15 is a table showing the results of Experimental Examples 1 to 3 and Comparative Examples 1 to 6.

FIG. 15 shows that the cleaning rollers according to Experimental Examples have an appropriate foreign-substance-removing performance.

In Experimental Example 1, an increase in surface resistance of the charging roller 121 after the images are formed on the recording paper sheets 5 (50 KPV) is about 1.2 logΩ, and the result of evaluation of the streaks on the print sample is "Good", which means that the result is favorable. When the surface of the charging roller 121 is observed with the scanning electron microscope, it is found that only a small amount of toner and external additives adhere to the projections 125*b*, and only a small amount of toner and external additives accumulate in the recesses 125*a*.

In Experimental Example 2, an increase in surface resistance of the charging roller 121 after the images are formed on the recording paper sheets 5 (50 KPV) is about 2.2 logΩ, and the result of evaluation of the streaks on the print sample is "Fair". When the surface of the charging roller 121 is observed with the scanning electron microscope, it is found that only a small amount of toner and external additives accumulate in the recesses 125*a*, but a somewhat large amount of toner and external additives adhere to the projections 125*b*.

In Experimental Example 3, an increase in surface resistance of the charging roller 121 after the images are formed on the recording paper sheets 5 (50 KPV) is about 2.5 logΩ, and the result of evaluation of the streaks on the print sample is "Fair". When the surface of the charging roller 121 is observed with the scanning electron microscope, it is found that only a small amount of toner and external additives accumulate in the recesses 125*a*, but a somewhat large amount of toner and external additives adhere to the projections 125*b*.

In Comparative Example 1, an increase in surface resistance of the charging roller 121 after the images are formed on the recording paper sheets 5 (50 KPV) is as large as 4.5 logΩ, and the result of evaluation of the streaks on the print sample is "Bad". When the surface of the charging roller 121 is observed with the scanning electron microscope, it is found that only a small amount of toner and external additives adhere to the projections 125*b*, but a very large amount of toner and external additives accumulate in the recesses 125*a*.

In Comparative Example 2, an increase in surface resistance of the charging roller 121 after the images are formed on the recording paper sheets 5 (50 KPV) is as large as 3.8 logΩ, and the result of evaluation of the streaks on the print sample is "Bad". When the surface of the charging roller 121 is observed with the scanning electron microscope, it is found that only a small amount of toner and external additives adhere to the projections 125*b*, but a large amount of toner and external additives accumulate in the recesses 125*a*.

In Comparative Example 3, an increase in surface resistance of the charging roller 121 after the images are formed on the recording paper sheets 5 (50 KPV) is as large as 5 logΩ, and the result of evaluation of the streaks on the print sample is "Very Bad". When the surface of the charging roller 121 is observed with the scanning electron microscope, it is found that a very large amount of toner and external additives adhere to the projections 125*b*, and a large amount of toner and external additives accumulate in the recesses 125*a*.

In Comparative Example 4, an increase in surface resistance of the charging roller 121 after the images are formed on the recording paper sheets 5 (50 KPV) is as large as 4.5 logΩ, and the result of evaluation of the streaks on the print sample is "Very Bad". When the surface of the charging roller 121 is observed with the scanning electron microscope, it is found that a very large amount of toner and external additives adhere to the projections 125*b*, and a large amount of toner and external additives accumulate in the recesses 125*a*.

In Comparative Example 5, an increase in surface resistance of the charging roller 121 after the images are formed on the recording paper sheets 5 (50 KPV) is 4.8 logΩ, which is the largest, and the result of evaluation of the streaks on the print sample is "Very Bad". When the surface of the charging roller 121 is observed with the scanning electron microscope, it is found that a very large amount of toner and external additives adhere to the projections 125*b*, and a large amount of toner and external additives accumulate in the recesses 125*a*.

In Comparative Example 6, an increase in surface resistance of the charging roller 121 after the images are formed on the recording paper sheets 5 (50 KPV) is as large as 4.2 logΩ, and the result of evaluation of the streaks on the print sample is "Very Bad". When the surface of the charging roller 121 is observed with the scanning electron microscope, it is found that a very large amount of toner and external additives adhere to the projections 125*b*, and a large amount of toner and external additives accumulate in the recesses 125*a*.

Experimental Example 4

Figure 21:
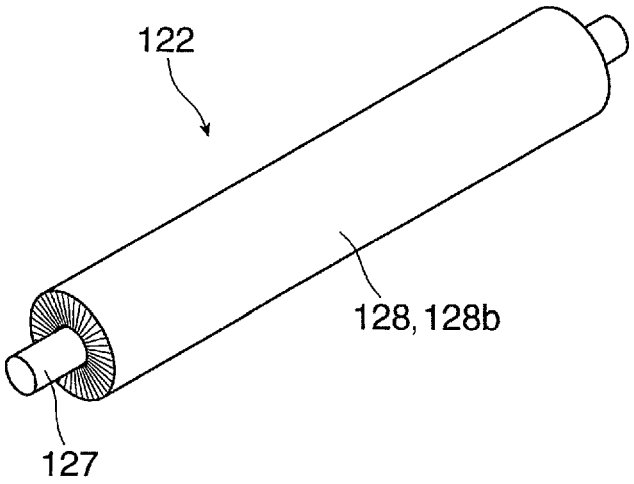
FIG. 21 is a perspective view of a modification of the cleaning roller.

To study the differences in cleaning performance depending on the cross-sectional shape of the second bristles 128*b* of the cleaning roller 122, the inventors of the present invention prepare cleaning rollers 122 including only the second bristles 128*b*, as illustrated in FIG. 21, and carry out an experiment to check the performance in cleaning the charging roller 121 as Experimental Example 4. The charging roller 121 is formed without adding filler particles to the surface layer 125 so that the charging roller 121 has a smooth surface. The cleaning rollers 122 include second bristles 128*b* having a circular cross-section (FIG. 9A), an elongated cross-section (FIG. 10A), a triangular cross-section (FIG. 10C), and a Y-shaped cross-section (FIG. 9B). Each cleaning roller 122 includes only the second bristles 128*b* attached to the outer periphery of the core bar 127 over the entire surface thereof.

The performance of each cleaning roller 122 in cleaning the charging roller 121 is evaluated by the following method. First, test images are formed on 4,000 A4-size recording paper sheets 5 without using the cleaning roller 122, so that the charging roller 121 is contaminated with, for example, the external additives of the toner, and that the resistance value is increased. Then, the cleaning roller 122 is attached to the charging roller 121 and rotated 200 revolutions to clean the charging roller 121 so that the resistance value of the charging roller 121 is reduced. The cleaning performance is evaluated on the basis of the amount of reduction in the resistance value of the charging roller 121. The reduction in the resistance value of the charging roller 121 is determined in terms of percentage (%) of recovery to the value before the charging roller 121 is used.

FIGS. 16 to 20 illustrate the result of Experimental Example 4.

Figures 16, 17:
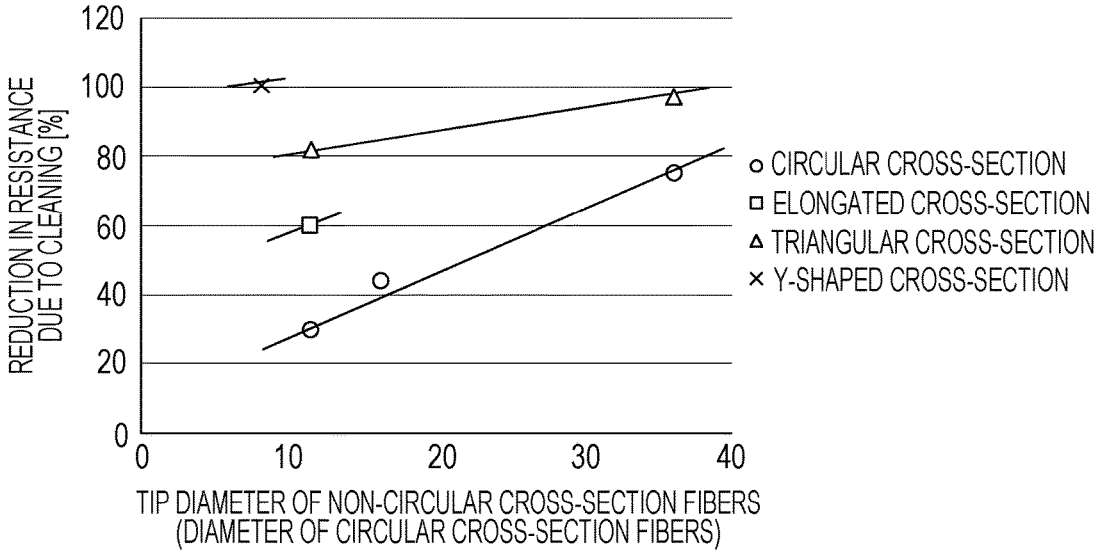
FIG. 16 is a table showing the result of Experimental Example 4.
FIG. 17 is a graph showing the result of Experimental Example 4.

FIGS. 16 and 17 are a table and a graph, respectively, showing the relationship between the tip diameter of the projecting portions of the bristles having a non-circular cross-section and the cleaning performance. FIGS. 16 and 17 show that, with regard to the bristles 128*b* having a non-circular cross section including the projecting portions 129 with a tip diameter of about 8 μm, the bristles having a Y-shaped cross-section have a cleaning performance of 100% in terms of the amount of reduction in the resistance value due to the cleaning roller 122, and is capable of substantially completely cleaning the charging roller 121. With regard to the bristles 128*b* having a non-circular cross section including the projecting portions 129 with a tip diameter of about 11.3 μm, the bristles having a triangular cross section have a cleaning performance of 82%, and the bristles having an elongated cross-section have a cleaning performance of 60%. The bristles having a circular cross-section have a cleaning performance of 30%. Thus, when the tip diameter of the projecting portions of the bristles having a non-circular cross section is about 11.3 μm, the bristles having a triangular cross-section have a relatively high cleaning performance of 82%, and the bristles having an elongated cross section have the next highest cleaning performance of 60%. The bristles having a circular cross section have the lowest cleaning performance of 30%.

In addition, FIGS. 16 and 17 show that with regard to the bristles 128*b* having a non-circular cross section including the projecting portions with a tip diameter of about 35.8 μm, the bristles having a triangular cross-section have a cleaning performance of 97%, which is close to 100%, and is capable of substantially completely cleaning the charging roller 121, similar to the bristles having a Y-shaped cross-section. In contrast, the cleaning performance of the bristles having a circular cross section is 75%, which is lower than the cleaning performance of the bristles having a Y-shaped cross-section.

FIGS. 16 and 17 show that when the tip diameter obtained by approximating the tip of each of the projecting portions of the bristles 128*b* having a non-circular cross section by a circle and the diameter of the bristles having a circular cross-section are both about 10 μm, the cleaning roller 122 including the bristles having a non-circular cross section causes a greater reduction in the resistance value, and therefore has a higher cleaning performance, than that including the bristles having a circular cross-section. The reason for this is probably that although the bristles that come into contact with the surface of the charging roller 121 have substantially the same diameter, the bristles having a non-circular cross-section has a higher rigidity, and therefore more effectively removes the foreign substances, such as the toner and external additives, than the bristles having a circular cross-section.

Figures 18, 19, 20:
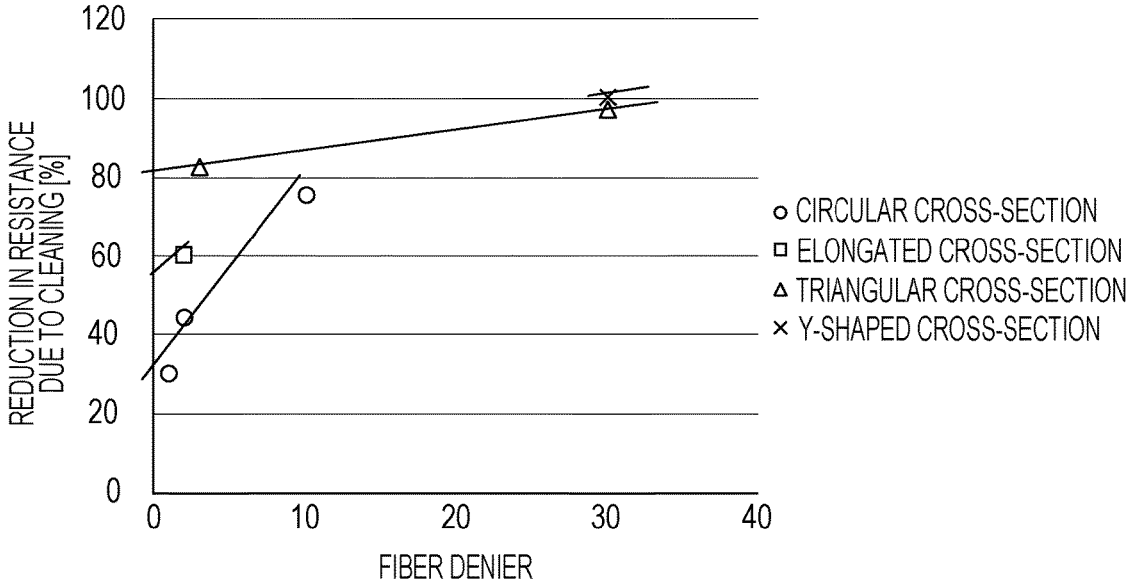
FIG. 18 is a table showing the conditions of Experimental Example 4.
FIG. 19 is a table showing the result of Experimental Example 4.
FIG. 20 is a graph showing the result of Experimental Example 4.

FIG. 18 is a table showing the relationship between the tip diameter of the projecting portions of the bristles having a non-circular cross-section and the overall thickness of the bristles in terms of denier.

FIGS. 19 and 20 are a table and a graph, respectively, showing the relationship between the overall thickness of the bristles having a non-circular cross-section (denier) and the cleaning performance based on the relationship between the tip diameter of the projecting portions of the bristles and the overall thickness of the bristles in terms of denier shown in FIG. 18.

FIGS. 19 and 20 show that also when the bristles having a non-circular cross-section and the bristles having a circular cross-section have the same denier, the cleaning roller including the bristles having a non-circular cross section causes a greater reduction in the resistance value, and therefore has a higher cleaning performance, than that including the bristles having a circular cross-section. The reason for this is probably that although the bristles have substantially the same rigidity since they have the same denier, the bristles having a non-circular cross-section have a smaller diameter (are thinner) when each of the projecting portions is approximated by a circle. The projecting portions of the bristles easily enter small recesses in the surface of the charging roller 121 and scrape off the foreign substances, such as the toner and external additives, to clean the surface of the charging roller 121.

In addition, FIG. 20 shows that, with regard to the bristles having a non-circular cross-section which have circumcircles with substantially the same diameter and whose denier is about 30, the cleaning roller 122 including the bristles having a triangular cross-section and that including the bristles having a Y-shaped cross-section both cause a reduction in the resistance value of approximately 100%, and have a very high cleaning performance.

In the above-described exemplary embodiment, a full-color image forming apparatus that forms four toner images, which are yellow (Y), magenta (M), cyan (C), and black (K) toner images, is described as an image forming apparatus. However, the image forming apparatus may, of course, instead be configured to form a monochrome image.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A cleaning member comprising:

a plurality of bristles of non-circular cross section, including tips that come into contact with an object to be cleaned having a surface including recesses and projections; and a brush base to which the bristles are attached, wherein each bristle has a longitudinal axis oriented in a direction from the brush base to the tip of the bristle and comprises a projecting portion that projects radially from the longitudinal axis a projecting length dl, wherein dl is greater than the maximum height Rz of the projections on the surface to be cleaned, wherein the tips are located at the outer periphery of the projecting portion of the bristles, and wherein, the expressions Sm>db and dc>db are satisfied, where Sm is an average value of a distance between the recesses and projections that are adjacent to each other, db is a maximum width of the projecting portion of each bristle in cross section, and dc is a diameter of each bristle in cross section.

2. The cleaning member according to claim 1, wherein, when D is a diameter of a circumcircle of each bristle, each bristle satisfies the following expression:

$$D<Sm.$$

3. The cleaning member according to claim 1, wherein a rigidity of the projecting portion of each bristle is higher than a rigidity of a bristle of the same material having a circular cross-section and an outer diameter equal to a maximum width db of the projecting portion.

4. The cleaning member according to claim 3, wherein the non-circular cross-section of each bristle includes a plurality of the projecting portions.

5. A cleaning member comprising:

a plurality of first bristles and a plurality of second bristles including tips that come into contact with an object to be cleaned having a surface including recesses and projections; and a brush base to which the bristles are attached, wherein the first and second bristles have different diameters, wherein the first bristles each have a thickness such that the first bristles do not reach bottoms of the recesses in the object to be cleaned, wherein each of the second bristles has a non-circular cross-section and a longitudinal axis oriented in a direction from the brush base to a tip of said second bristle and comprises a projecting portion that projects radially from the longitudinal axis a projecting length dl, wherein dl is greater than a maximum height Rz of the projections on the surface to be cleaned.

6. The cleaning member according to claim 5, wherein, the expression da>Sm>db is satisfied where Sm is an average value of a distance between the recesses and projections that are adjacent to each other, da is a diameter of each of the first bristles in cross section, and db is a maximum width of the projecting portion of each of the second bristles in cross section.

7. The cleaning member according to claim 6, wherein the brush base includes a region in which only the first bristles are attached and a region in which only the second bristles are attached, and wherein the first bristles and the second bristles both come into contact with the object to be cleaned over an entire region to be cleaned.

8. The cleaning member according to claim 7, wherein the region in which only the first bristles are attached and the region in which only the second bristles are attached are helically arranged around the brush base, which is shaft-shaped.

9. The cleaning member according to claim 7, wherein the region in which only the first bristles are attached and the region in which only the second bristles are attached extend continuously in an axial direction of the brush base, which is shaft-shaped, and are alternately arranged in a circumferential direction of the brush base.

10. A charging device comprising:

a charging member that is roller-shaped and that charges a surface of an image carrier; and a cleaning member that is supported so that bristles of the cleaning member contact a surface of the charging member and that cleans the surface of the charging member, wherein the cleaning member is the cleaning member according to claim 1.

11. A charging device comprising:

a charging member that is roller-shaped and that charges a surface of an image carrier; and a cleaning member that is supported so that bristles of the cleaning member contact a surface of the charging member and that cleans the surface of the charging member, wherein the cleaning member is the cleaning member according to claim 5.

12. An image forming apparatus comprising:

an image carrier including an endless peripheral surface on which an electrostatic latent image is formed; and the charging device according to claim 10 that contacts and charges the peripheral surface of the image carrier.

13. An image forming apparatus comprising:

an image carrier including an endless peripheral surface on which an electrostatic latent image is formed; and the charging device according to claim 11 that contacts and charges the peripheral surface of the image carrier.

14. The cleaning member according to claim 4, wherein a number of projecting portions is 3.

15. The cleaning member according to claim 1, wherein the non-circular cross-section of each bristle includes a plurality of the projecting portions.

16. The cleaning member according to claim 15, further comprising an angle between each projecting portion, wherein the angle between each projecting portion is substantially equal, wherein the projecting portions of the bristles form arms of an angle and the longitudinal axis of the bristle is a vertex of the angle used to measure the angle between each projecting portion.

17. The cleaning member according to claim 14, further comprising an angle between each projecting portion, wherein the angle between each projecting portion is approximately 120 degrees, wherein the projecting portions of the bristles form arms of an angle and the longitudinal axis of the bristle is a vertex of the angle used to measure the angle between each projecting portion.

* * * * *